US009512528B2

(12) United States Patent
Botrel

(10) Patent No.: US 9,512,528 B2
(45) Date of Patent: Dec. 6, 2016

(54) METHOD OF SYNTHESIZING A METAL FOAM, METAL FOAM, USES THEREOF AND DEVICE COMPRISING SUCH A METAL FOAM

(71) Applicant: Commissariat A L'energie Atomique et aux Energies Alternatives, Paris (FR)

(72) Inventor: Ronan Botrel, Marey sur Tille (FR)

(73) Assignee: Commissariat A L'energie Atomique et aux Energies Alternatives, Paris (FR)

( * ) Notice: Subject to any disclaimer, the term of this patent is extended or adjusted under 35 U.S.C. 154(b) by 0 days.

(21) Appl. No.: 14/329,190

(22) Filed: Jul. 11, 2014

(65) Prior Publication Data

US 2015/0014172 A1 Jan. 15, 2015

(30) Foreign Application Priority Data

Jul. 12, 2013 (FR) ..... 13 56875

(51) Int. Cl.

| | |
|---|---|
| ***C25D 1/08*** | (2006.01) |
| ***C25D 3/38*** | (2006.01) |
| *C25D 7/00* | (2006.01) |

(52) U.S. Cl.

CPC . *C25D 1/08* (2013.01); *C25D 3/38* (2013.01); *C25D 7/005* (2013.01)

(58) Field of Classification Search

CPC ..... C25D 1/08; C25D 3/38; C25D 7/005
See application file for complete search history.

(56) References Cited

U.S. PATENT DOCUMENTS

| | | | | |
|---|---|---|---|---|
| 3,823,074 | A | 7/1974 | Minbiole et al. | |
| 3,823,083 | A | 7/1974 | Minbiole et al. | |
| 4,053,371 | A * | 10/1977 | Towsley | C25B 1/46 205/50 |
| 4,139,424 | A | 2/1979 | Herrnring | |
| 4,316,786 | A | 2/1982 | Yu et al. | |
| 4,801,947 | A * | 1/1989 | Lichtenberger | B41J 2/162 205/127 |

(Continued)

FOREIGN PATENT DOCUMENTS

| | | |
|---|---|---|
| DE | 2543599 A1 | 4/1977 |
| GB | 1301678 | 1/1973 |

(Continued)

OTHER PUBLICATIONS

Azumi et al., "Removal of oxide layer on SUS304 using high-voltage discharging polarization". Electrochimica Acta 52 (2007), pp. 4463-4470.

(Continued)

*Primary Examiner* — Ciel Thomas
(74) *Attorney, Agent, or Firm* — Miles & Stockbridge P.C.

(57) ABSTRACT

A method of synthesizing a metal foam of at least one metal M having a porous micrometric structure, the method including a step of contact glow discharge electrolysis in an electrolytic plasma reduction conducted in an electrolytic solution in which are immersed an anode and a cathode connected to a continuous electrical power supply, the electrolytic solution including at least one first electrolyte in a solvent, the first electrolyte being the at least one metal M in cationic form, the electrolytic solution further including a gelatine, as well as a metal foam obtained by this method, and a device comprising such a foam.

40 Claims, 9 Drawing Sheets

(56) References Cited

U.S. PATENT DOCUMENTS

| | | | | |
|---|---|---|---|---|
| 5,759,381 | A * | 6/1998 | Sakurai | C25D 3/60 106/1.25 |
| 8,246,797 | B2 | 8/2012 | Botrel et al. | |
| 2003/0052011 | A1* | 3/2003 | Chen | C23C 16/50 205/80 |
| 2004/0074338 | A1* | 4/2004 | Kuhn | B22F 3/1021 75/415 |
| 2006/0204741 | A1 | 9/2006 | Rehbein et al. | |
| 2011/0318600 | A1* | 12/2011 | Matsunaga | C25D 1/08 428/606 |
| 2013/0321983 | A1* | 12/2013 | Chung | C25D 5/48 361/502 |

FOREIGN PATENT DOCUMENTS

| | | | | |
|---|---|---|---|---|
| JP | 58-81990 | | 5/1983 | |
| WO | WO 2006/111837 | A2 | 10/2006 | |
| WO | WO 2012093880 | A2 * | 7/2012 | C25D 5/48 |

OTHER PUBLICATIONS

Kareem et al., "Glow discharge plasma electrolysis for nanoparticles synthesis". Ionics (2012), pp. 315-327.

Kim et al., "Preparation of copper foam with 3-dimensionally interconnected spherical pore network by electrodeposition". Electrochemistry Communications 10 (2008), pp. 1148-1151.

Takai, "Solution plasma processing (SPP)". Pure Appl. Chem. 80 (2008), pp. 2003-2011.

Wuthrich et al., "Building micro and nanosystems with electrochemical discharges". Electrochimica Acta 55 (2010), pp. 8189-8196.

Zhou et al., "Nanoporous platinum grown on nickel foam by facile plasma reduction with enhanced electro-catalytic performance". Electrochemistry Communications 18 (2012), pp. 33-36.

French Search Report dated Mar. 11, 2014, for French Patent Application No. 1356875.

French Preliminary Search Report dated Oct. 6, 2005 for French Patent Application No. 666095 (2 pages).

International Search Report dated Jul. 5, 2007 for International Application No. PCT/FR2006/000732 (4 pages).

* cited by examiner

METHOD OF SYNTHESIZING A METAL FOAM, METAL FOAM, USES THEREOF AND DEVICE COMPRISING SUCH A METAL FOAM

TECHNICAL FIELD

The invention relates to a method of synthesizing a low density metal foam, such a foam having a three-dimensional porous micrometric structure. It is pointed out that "micrometric structure" is taken to mean a structure in which the constituent elements, namely the strands, have a dimension, or length, comprised between 0.1 μm and 100 μm, or even comprised between 0.01 μm and 100 μm.

The invention also relates to a porous metal foam and in which the strands have a dimension, or length, comprised in these same ranges, said metal foam being capable of being obtained by this synthesis method.

The invention also relates to the use of such a metal foam, in particular in the field of catalysis and electronics.

The invention finally relates to a device comprising such a metal foam, such a device being able in particular to be constituted of a microelectrode or of a micro-sensor.

STATE OF THE PRIOR ART

Numerous works are currently underway to synthesize low density metal foams with a view to their use in numerous application fields, such as catalysis, absorbents and electronics and/or in varied devices such as sensors, batteries and devices for storing gas such as hydrogen.

The expression "low density metal foam" is taken to mean a metal foam in which the apparent density is less than or equal to 10% of the theoretical density of the corresponding metal.

Such metal foams are constituted of metal materials that have a micrometric, or even nanometric, three-dimensional porous structure. It is pointed out that the expression "nanometric structure" or instead the term "nanostructure" is taken to mean a structure in which the constituent elements, namely the strands, have a dimension, or length, comprised between 1 nm and 100 nm.

By virtue of their micrometric structure, these metal foams have a high specific surface, which confers them with numerous advantages, among which that of offering very rapid electrochemical response capacity. It may thus be envisaged to use these metal foams to manufacture gas micro-sensors and microelectrodes, such microelectrodes being able to be in particular intended for the electronics industry.

Among known methods enabling the synthesis of metal foams, the method may be cited which implements an electrolysis known as "high current density" during which the electrolytic reduction of the metal cation present in the electrolytic solution takes place. According to this method, this electrolytic reduction of the metal ion (1) is accompanied by the concomitant electrolytic reduction of water (2). The corresponding electrolytic reduction reactions, which occur at the surface of the cathode, are respectively the following:

$$M^{n+}+ne^{-}\rightarrow M \quad (1)$$

$$2H^{+}+2e^{-}\rightarrow H_2\nearrow \quad (2),$$

with M representing the metal and n being a whole number.

The electrolytic reduction of water produces, at the surface of the cathode, a gaseous release formed of a multitude of bubbles of hydrogen which are going to serve as matrix for the formation of interstices or pores of the metal foam. One thus observes, at the surface of the cathode, the deposition of the metal M reduced in the form of a metal foam. In fact, this deposition has a porous structure, the formation of the pores being assured by the bubbles of hydrogen derived from the reduction of the water present in the electrolyte. Nevertheless, it may be observed that the pores of the metal foam, as obtained by this method of electrolytic reduction at high current density, do not have a regular and homogenous size, this size increasing in particular with the thickness of the metal foam due to a phenomenon of coalescence of the bubbles of hydrogen released. Moreover, the thickness of this metal foam deposited on the surface of the cathode is limited to several hundreds of micrometers, also due to this phenomenon of coalescence of the bubbles of hydrogen released. It is observed, furthermore, that this metal foam is very fragile and that it may not be handleable and even less shaped.

A recent publication of C. Zhou et al. ("*Nanoporous platinum grown on nickel foam by facile plasma reduction with enhanced electro-catalytic performance*", Electrochemistry Communications, 2012, 18, 33-36), referenced [1] at the end of the present description, describes another method of synthesizing metal foam, said method comprising a step of contact glow discharge electrolysis.

Contact glow discharge electrolysis (CGDE) is a method that has seen a regain of interest in several research fields over the last few years.

In the publication of K. Azumi et al. ("*Removal of oxide layer on SUS*304 *using high-voltage discharging polarization*", Electrochimica Acta, 2007, 52, 4463-4470), referenced [2], the authors describe the implementation of this CGDE method for the treatment of oxidised surfaces.

Reference may also be made to the 2010 publication of R. Wüthrich et al. ("*Building micro and nanosystems with electrochemical discharges*", Electrochimica Acta, 2010, 55, 8189-8196), referenced [3], which reviews applications of this CGDE method described in the literature. Among these applications, in particular may be cited the micro-machining of non-conductive materials, the treatment of waste water, surface treatment and the synthesis of nanoparticles. In particular, this publication [3] reports the synthesis of colloidal nanoparticles of nickel, copper, platinum or gold, of mixed colloidal nanoparticles of platinum and gold, as well as colloidal nanobeads of nickel, titanium, silver or gold. These nanoparticles or nanobeads are known as "colloidal" because they are in suspension in the electrolytic solution. Some of these nanoparticles are described as being able to attain particle sizes lying in a range extending from several tens of nanometers to several nanometers. Nickel nanoparticles having a particle size comprised between several nanometers and around 50 nm have in particular been synthesized as well as copper nanoparticles having a particle size comprised between 5 nm and around 30 nm. Nevertheless, the publication [3] does not describe in any way the synthesis of nanomaterials and even less metal foams. In fact, to control the size of the nanoparticles and to avoid the formation of a metal deposition at the cathode, this publication [3] teaches the use of a rotating disc electrode making it possible to assure a colloidal solution of nanoparticles is obtained. Within the context of the synthesis of nanobeads, observation of the surface of the cathode using a scanning electron microscope shows the presence of relatively dispersed nanospheres, which have a size of several hundreds of nanometers.

The 2011 publication of T. A. Kareem et al. ("*Glow discharge plasma electrolysis for nanoparticles synthesis*", Ionics, 2012, 18, 315-327), referenced [4], also reviews the different processes described to date to synthesize colloidal nanoparticles and, in particular, nanoparticles of copper, platinum or gold as well as mixed nanoparticles of platinum and gold, the sizes of these nanoparticles extending between 30 nm and 400 nm.

Unlike the publications [3] and [4], the publication [1] proposes the implementation of the contact glow discharge electrolysis method for the synthesis, not of colloidal metal nanoparticles, but of porous metal nanomaterials. More precisely, the publication [1] describes the synthesis of a composite material comprising the deposition of a nanoporous platinum foam, by such a CGDE method conducted at ambient temperature, on a nickel foam substrate. The tests conducted in the publication [1] show that, the higher the concentration of platinum $Pt^{4+}$ cations in the electrolytic solution, the more the surface of the nickel foam is covered with nanoporous platinum foam and the more the average diameter of the pores decreases, to attain a value of around 100 nm. Nevertheless, the images presented in this publication [1] do not really show metal foam of three-dimensional porous micrometric structure, the term "micrometric" being as defined above. In addition, nothing in this publication [1] indicates that the nanoporous platinum foam can be isolated from the nickel foam on which it is deposited in order, for example, to be shaped.

The aim of the invention is, consequently, to overcome the drawbacks of the prior art and to propose a method of synthesizing a low density metal foam, which has a three-dimensional porous micrometric, or even porous nanometric, structure, said structure being moreover regular and homogenous throughout its thickness, unlike the foam obtained with the high current density electrolysis method.

This method must moreover make it possible to obtain a metal foam having a certain thickness, such a thickness being advantageously at least 0.1 mm, such a metal foam being moreover sufficiently solid to enable its handling, or even a complementary shaping step, in particular by machining, to confer thereto a form that is, for example, compatible with a potential use of such a metal foam.

DESCRIPTION OF THE INVENTION

The aforementioned aims and others are attained, firstly, by a method of synthesizing a metal foam of at least one metal M, said metal foam having a three-dimensional porous micrometric structure.

According to the invention, this method comprises a step of contact glow discharge electrolysis, said electrolysis consisting in an electrolytic plasma reduction conducted in an electrolytic solution in which are immersed an anode and a cathode connected to a continuous electrical power supply, the electrolytic solution comprising at least one first electrolyte in a solvent, the first electrolyte being said at least one metal M in cationic form, the electrolytic solution further comprising gelatine.

The contact glow discharge electrolysis (CGDE) method, also designated "electrolytic plasma" electrolysis method, is a particular electrolytic method in which a plasma known as "electrolytic plasma" is localised between a polarised electrode and the electrolytic solution in which the electrodes are immersed.

This electrolytic plasma is formed from an electric voltage known as "critical electric voltage", following the ionisation of the gas that surrounds the polarised electrode and which is itself formed beforehand during the electrolytic reduction, or the electrolytic oxidation, of the solvent and of some of the compounds that are found to be ionised in the electrolytic solution.

Within the scope of the present invention, the electrolytic plasma, which is in the form of a gaseous envelope, is formed at the surface of the cathode. The presence of gelatine in the electrolytic solution, combined with the application of a continuous current, makes it possible to maintain and to contain, around the cathode, this gaseous envelope and, consequently, the electrolytic plasma.

In doing so, by maintaining the electrolytic plasma at the surface of the cathode, the gelatine favours the growth of the metal foam from the metal M present in cationic form, $M^{n+}$, in the electrolytic solution.

More precisely, the metal foam synthesized by the method according to the invention is constituted of strands, said strands being obtained by germination then growth of the reduced metal ions. Said strands correspond, in fact, to the imprints left by the electric micro-arcs formed during the contact glow discharge electrolysis. These electric micro-arcs assure the reduction, by electron transfer, of the metal cation $M^{n+}$ into metal M as soon as said electric micro-arcs enter into contact with the electrolytic solution. The presence of gelatine, by maintaining the gaseous envelope around the cathode, makes it possible to support the formation of said electric micro-arcs in the space formed by said gaseous envelope, i.e. in the volume comprised between the cathode and the electrolytic solution. These electric micro-arcs, which come from the surface of the cathode, propagate to the end of each progressively formed metal strand, thereby leading to an expansion of the synthesized metal foam, which continues as long as the gaseous envelope is maintained. This propagation of the electric micro-arcs at the ends of the metal strands formed makes it possible to assure a synthesis of metal foam of particularly homogenous density and to do so throughout its thickness, while preventing any densification at the core of the metal foam.

Thanks to the synthesis method according to the invention, it is possible to obtain a metal foam that is characterised by a very low apparent density, typically less than or equal to 10%, or even less than or equal to 0.5%, and/or by a specific surface, measured according to the BET method, that is particularly high, typically greater than or equal to 250 $m^2/g$.

It is pointed out that the expression "apparent density" is taken to mean the percentage represented by the density of the metal foam considered compared to the density of the corresponding metal M. A similar notion is the "relative density", which expresses the ratio between the density of the metal foam and the density of this same metal M.

Although of very low apparent density, the metal foam synthesized by the method according to the invention remains, moreover, perfectly handleable.

In addition, and unlike the method of synthesizing metal foam described in the publication [1], the method according to the invention makes it possible to obtain a significant thickness of metal foam, said thickness being at least equal to 0.1 mm and, preferably, greater than or equal to 0.5 mm.

The method according to the invention makes it possible, in fact, to attain thicknesses of metal foam that can go up to several centimeters.

Obviously, it may entirely be envisaged to carry out a deposition of metal foam having a thickness below 0.1 mm, in particular for reasons and/or requirements directly linked to the subsequent use of said metal foam.

Moreover, the synthesis method according to the invention makes it possible to form a metal foam directly at the surface of the cathode, and not necessarily on a nickel foam substrate as is the case of the synthesis method described in the publication [1]. It may thus be envisaged to obtain directly a metal foam of at least one metal M, without it being necessary to resort to a complementary step of separation with a metal foam substrate, for example a nickel foam substrate such as that taught by the publication [1].

Nevertheless, within the scope of the present invention, nothing prevents implementing the synthesis method with a cathode comprising, at its surface, at least one metal foam substrate already formed, for example made of a metal other than the metal M.

It is also possible to envisage successive depositions of metal foams, so as to form a multilayer deposition of metal foams, these metal foams being able to be formed from the same metal M or from at least two different metals $M_1$ and $M_2$.

It is pointed out that "continuous electrical power supply" is taken to mean an electrical power supply that delivers a continuous current, in other words a continuously circulating current and which is thus not interrupted during the contact glow discharge electrolysis method, in contrast to an alternating or pulsed current.

Moreover, the maintaining of the electrolytic plasma also makes it possible to maintain substantially constant conditions of electrolytic reduction, which favour a metal foam provided with a regular and homogenous structure throughout its thickness being obtained.

It may be noted that the use of gelatine in an electrolytic solution has been fortuitously mentioned in the publication [4], which refers to a prior publication of O. Takai ("*Solution plasma processing* (*SPP*)", Pure Appl. Chem., 2008, 80(9), 2003-2011), referenced [5].

In this publication [5], colloidal nanoparticles of gold of a size of 10 nm have in fact been synthesized by a plasma in solution method, implemented under an applied electric voltage of 2500 V and under a pulse width of 2 μs, from an electrolytic solution comprising an aqueous solution formed of $HAuCl_4$ as electrolyte as well as KCl and gelatine as additives. Yet, the plasma in solution method described in this publication [5] is not comparable with the contact glow discharge electrolysis method implemented in the method according to the invention. In fact, the application of a high electric voltage of 2500 V combined with an electrolysis time of 2 μs does not enable the gaseous envelope, and thus the electrolytic plasma, to form and above all to be maintained and to be contained in a localised manner around the single cathode, unlike what occurs in the synthesis method of the invention in which a continuous current is implemented.

Moreover, the publication [5] teaches that the use of gelatine makes it possible to prevent the aggregation of the synthesized gold nanoparticles, unlike the effect that gelatine produces on the electrolytic plasma, as the inventor has demonstrated. This clearly shows, if it were still necessary, that the synthesis method according to the invention can be clearly distinguished from the plasma in solution method described by the publication [5].

Generally speaking, the method according to the invention may be implemented at ambient temperature. But it may also be envisaged to implement it at other temperatures, below or above said ambient temperature.

In an advantageous variant of the invention, the method of synthesizing a metal foam comprises the following successive steps:

- the introduction of the anode and the cathode into the electrolytic solution,
- the application of an electric voltage, delivered by the continuous electrical power supply, greater than or equal to the critical electric voltage $U_c$, so as to form at least partially the electrolytic plasma around the cathode,
- the maintaining of said electric voltage so as to form electric micro-arcs that reduce the metal M in cationic form present in the electrolytic solution, so as to form the metal foam of the metal M on the surface of the cathode,
- the withdrawal of the cathode from the electrolytic solution, and
- the potential collection of the metal foam of the metal M formed on the surface of the cathode.

The method according to the invention thus makes it possible to synthesize, in a single step and relatively easily, the metal foam formed of the metal M, from cations of the metal M present in the electrolytic solution. A second step of complementary collection makes it possible to isolate the metal foam thereby formed on the surface of the cathode.

The determination of the critical electric voltage, noted $U_c$, for a given electrolytic solution is done by establishing the curve of the intensity, noted I (in A), measured as a function of the applied electric voltage, noted U (in V), as is detailed hereafter, in particular in the chapters entitled "*Demonstration of the electrolysis method by electrolytic plasma*" and "*Effects of gelatine on the curve of the intensity as a function of the applied electric voltage*", with reference to FIGS. 2 and 13, respectively.

According to a particular embodiment of the invention, the applied electric voltage is situated in a range of electric voltages in which the intensity is substantially constant as a function of said electric voltage.

In this particular range of electric voltages, in which the current is stable, the electrolytic plasma is integrally formed around the cathode. Thus, the implementation of the method according to the invention over such a range of electric voltages makes it possible to achieve very good reproducibility of the porous micrometric structures of the metal foams.

According to a particularly advantageous variant of the invention, the cathode is withdrawn from the electrolytic solution before cutting off the electric voltage.

In fact, the fact of withdrawing the cathode from the electrolytic solution while maintained under electric voltage makes it possible to obtain a metal foam which is not only dry but which, moreover, perfectly conserves its integrity.

According to another advantageous variant, the method according to the invention may further comprise at least one or more complementary steps, taken alone or in combination.

In particular, the method according to the invention may comprise at least one of the following complementary steps:

- the stirring of the electrolytic solution,
- the rotation of the cathode, at least when the cathode is arranged in the electrolytic solution.

The stirring of the electrolytic solution enables a homogenous mixing of the ionic species present in said electrolytic solution, thereby making it possible to maintain the presence of metal cations $M^{n+}$ in the immediate vicinity of the gaseous envelope and, hence, the reduction of said cations in the form of strands. This stirring may in particular be carried out using a rotating magnetic stirring bar, the rotation being for example assured by a magnetic stirrer or a magnetic stirring bar.

The rotation of the cathode may in particular be assured by attaching said cathode to a rotating motor.

Rotating the cathode, during the application then during the maintaining of the electric voltage, makes it possible to form a metal foam of perfectly homogenous and regular thickness at the surface of said cathode, but also to vary the form and the apparent density, or relative density, of the metal foam.

In fact, rotating the cathode makes it possible to further reduce the apparent density of the metal foam down to apparent density values that may be of the order of 0.2%, the metal foam remaining, furthermore, perfectly handleable. It is possible, in particular, to synthesize a metal foam having simultaneously an apparent density of the order of 0.2% and/or a BET specific surface of the order of 500 $m^2/g$.

This reduction in the apparent density inherent in rotating the cathode in the electrolytic solution occurs nevertheless, without the structure in the form of strands, in particular strands having a dimension, or length, comprised between 0.1 μm and 100 μm, or even comprised between 0.01 μm and 100 μm, being degraded.

It is important to note that the cathode may be rotated up to an angular velocity of 5000 rpm, without risk of degradation of the synthesized metal foam, the latter being in some way protected by the gaseous envelope that surrounds it.

According to an embodiment of the invention, the value of the electric voltage applied at the electrodes is comprised between 10 V and 100 V, advantageously between 15 V and 50 V and, preferably, between 20 V and 30 V.

It is pointed out that the expression "comprised between . . . and . . . ", which has just been cited and which is used in the present application, should be understood as defining not only the values of the range, but also the boundary values of said range.

According to another embodiment of the invention, the value of the electric voltage applied at the electrodes is maintained for a duration comprised between 5 s and 5 min, advantageously between 10 s and 2 min and, preferably, between 20 s and 60 s.

According to another embodiment of the invention, the method of synthesizing metal foam further comprises a step of shaping the metal foam collected.

This shaping step may in particular be a machining of the metal foam as collected at the end of the synthesis method according to the invention.

It is also possible to envisage that this shaping step consists in an electroforming. Thus, the growth of the metal foam is carried out on a cathode which has a shape corresponding to the shape that it is wished to give to said metal foam.

Nothing prevents envisaging that this shaping by electroforming is followed and completed by a shaping by machining.

As indicated previously, the electrolytic solution comprises gelatine.

It is important to note that the effect conferred to the electrolytic plasma and, more generally, to the synthesized metal foam, by the presence of gelatine is obtained even at very low concentrations of gelatine in the electrolytic solution.

Advantageously, this gelatine concentration in the electrolytic solution is less than or equal to 200 g/l, advantageously comprised between 1 g/l and 100 g/l, preferably comprised between 5 g/l and 50 g/l and, even more preferentially, comprised between 10 g/l and 25 g/l.

Obviously, gelatine concentration in the electrolytic solution is taken to mean the concentration of gelatine in solution in the electrolytic solution and before the implementation of the contact glow discharge electrolysis.

It may be pointed out that it is advantageous to introduce, into the electrolytic solution, gelatine in powder form. To assure the complete dissolution of the gelatine in the electrolytic solution, it may prove to be necessary to heat said electrolytic solution.

According to another embodiment of the invention, the first electrolyte present in the electrolytic solution is a metal salt in which the metal M, in cation form, combines with at least one anion and, if need be, with one or more cations to form, for example, double or triple metal salts.

Advantageously, this metal salt comprises at least one element selected from a sulphate $SO_4^{2-}$, a nitrate $NO_3^-$, a halide $X^-$ (such as $Cl^-$, $Br^-$ or $I^-$), a cyanide $CN^-$ and a hydroxide $OH^-$ of the metal M.

According to an embodiment of the invention, the concentration of the first electrolyte, in the electrolytic solution, is less than or equal to the solubility of said first electrolyte in the solvent.

Thus, the first electrolyte is found to be integrally in solution in the electrolytic solution.

As previously for gelatine concentration, concentration of first electrolyte in the electrolytic solution is taken to mean the concentration of this first electrolyte in solution in the electrolytic solution and before the implementation of the contact glow discharge electrolysis.

Advantageously, this concentration of first electrolyte is comprised between 0.1 mol/l and 2 mol/l and, preferably, comprised between 0.2 mol/l and 1 mol/l.

According to another embodiment of the invention, the solvent of the electrolytic solution is water and, preferably, demineralised water.

It may however also be envisaged to use other solvents, these being able to be water free.

Thus it may in particular be envisaged to use organic solvents, such as alcohols, ethers, hydrocarbons, in particular aromatic hydrocarbons such as benzene or toluene.

It is also possible to use solvents such as molten salts. In such a hypothesis, the synthesis method will not be carried out at ambient temperature, but at electrolytic solution temperatures that are compatible with an electrolysis method in molten salt medium.

According to another embodiment of the invention, the electrolytic solution further comprises at least one second electrolyte.

This second electrolyte is selected so that it is able to improve the electrical conductivity of the electrolytic solution.

According to a variant of the invention, the second electrolyte is a strong electrolyte, which has the advantage of dissociating or ionising totally or practically totally in the solvent of the electrolytic solution.

This second electrolyte present in the electrolytic solution is advantageously selected from a salt, an acid or a base.

Among salts, in particular sodium chloride NaCl or potassium chloride KCl may be cited.

Among acids, sulphuric acid $H_2SO_4$ may in particular be cited.

Among bases, sodium hydroxide or soda NaOH may in particular be cited.

According to an embodiment of the invention, the concentration of the second electrolyte, in the electrolytic solution, is less than or equal to the solubility of said second electrolyte in the solvent.

Thus, the second electrolyte is found to be integrally in solution in the electrolytic solution.

As previously for gelatine concentration, concentration of second electrolyte in the electrolytic solution is taken to mean the concentration of this second electrolyte in solution in the electrolytic solution and before the implementation of the contact glow discharge electrolysis.

Advantageously, this concentration of second electrolyte is comprised between 0.1 mol/l and 18 mol/l and, preferably, comprised between 0.5 mol/l and 10 mol/l.

In the synthesis method according to the invention, there is no particular requirement in terms of arrangement of the electrodes, except that the cathode and the anode must be positioned so that the circulation of the continuous electrical current cannot be interrupted. It will be noted in passing that the publication [5] imposes a very restricted gap of 0.3 mm of the electrodes.

In an advantageous embodiment of the invention, the cathode is made of a material having a high melting temperature, of at least 1500° C. It is possible in particular to envisage the use of a cathode made of stainless steel, tantalum or tungsten.

In an advantageous embodiment of the invention, the cathode is rotating, in particular when a shaping by electroforming of the metal foam is envisaged.

In an advantageous embodiment of the invention, the anode is made of an inert metal. Thus, the anode, the seat of the oxidation reactions that take place with some of the compounds present in the electrolytic solution, does not dissolve during the electrolytic plasma electrolysis method.

Such an anode may in particular be made of platinum.

In another advantageous embodiment of the invention, the anode is made of the metal M. One then speaks of a "soluble anode" because it is consumed during the CGDE method.

Thus, under the effect of the electrolytic oxidation that occurs at the soluble anode made of metal M during the contact glow discharge electrolysis and, if need be, the corrosive action of the second electrolyte (the strong electrolyte) when it is present in the electrolytic solution, said electrolytic solution, which furthermore already comprises metal cations $M^{n+}$ immediately available coming from the dissociation of the first electrolyte, becomes enriched in metal cations $M^{n+}$, according to the following electrolytic oxidation reaction (3):

$$M \rightarrow M^{n+} + ne^- \quad (3)$$

The metal M is obviously chosen so as to be able to be reduced by electrolysis in the electrolytic solution implemented.

In an advantageous embodiment of the invention, the metal M comprises at least one element selected from transition metals and poor metals.

Thus, the metal M may consist of a single metal, whether it is a transition metal or poor metal, but it may also comprise two metals, or even more, and thereby form a metal alloy.

Among transition metals, in particular may be cited transition metals of the tenth and eleventh columns, such as nickel, palladium, platinum, copper, silver and gold.

Among poor metals, tin may in particular be cited.

Advantageously, the metal M comprises at least one element selected from nickel, copper, silver, tin, platinum and gold.

For the synthesis of copper foam, it is possible in particular to envisage using copper sulphate, for example hydrated copper sulphate $CuSO_4$, $5H_2O$, as first electrolyte. It is also possible to envisage using a double metal salt such as potassium cuprocyanide $Cu(CN)_2K$. For the synthesis of gold foam, it may be envisaged to use the compound $HAuCl_4$, as described in the publication [5].

The implementation of the method according to the invention makes it possible to obtain a metal foam of metal M formed at the surface of the cathode which has advantageously one and/or the other of the following characteristics:

- a thickness comprised between 0.1 mm and 10 mm, advantageously between 0.3 mm and 5 mm and, preferably, between 0.5 mm and 2 mm,
- an apparent density ρ less than or equal to 10%, advantageously comprised between 1% and 8% and, preferably, comprised between 1.5% and 5% of the theoretical density of the corresponding metal M.

In particular, in the case where M=Cu, the method according to the invention makes it possible to obtain a copper foam with an apparent density ρ less than or equal to 1 $g/cm^3$, advantageously comprised between 0.10 $g/cm^3$ and 0.80 $g/cm^3$ and, preferably, comprised between 0.15 $g/cm^3$ and 0.50 $g/cm^3$.

The invention relates to, secondly, a metal foam of at least one metal M having a porous micrometric structure, in other words a porous structure and in which the constituent elements, in this particular case the strands, have a dimension, or length, comprised between 0.1 μm and 100 μm, or even comprised between 0.01 μm and 100 μm.

According to the invention, said metal foam is capable of being obtained by the implementation of the synthesis method that has been defined above.

More particularly, said metal foam is capable of being obtained by the method comprising a step of contact glow discharge electrolysis, said electrolysis consisting in an electrolytic plasma reduction conducted in an electrolytic solution in which are immersed an anode and a cathode connected to a continuous electrical power supply, the electrolytic solution comprising at least one first electrolyte in a solvent, the first electrolyte being said at least one metal M in cationic form, the electrolytic solution further comprising gelatine.

For the other advantageous characteristics of the method making it possible to synthesize the metal foam, reference will be made to what has been defined previously.

Such a metal foam according to the invention can be distinguished structurally from the deposition of nanoporous platinum obtained by the method described in the publication [1]. In fact, as indicated in the publication [1], the deposition of nanoporous platinum is formed of a stack of platinum nanoparticles derived from the reduction of the cations $Pt^{4+}$ and having a particle size distribution that is uniform. This stack, moreover observable in the images of this same publication [1], results in a nanoporous network characterised by a structure that can be distinguished very clearly from the structure of the metal foam according to the invention, structure which is constituted of strands.

As mentioned previously, the metal foam according to the invention is characterised by a very low apparent density, typically less than or equal to 10%, or even less than or equal to 0.5%, and/or by a specific surface, measured according to the BET method, which is particularly high, typically greater than or equal to 250 $m^2/g$.

The invention relates to, thirdly, the use of the metal foam of at least one metal M having a porous micrometric structure as defined above.

According to the invention, this metal foam is advantageously used in the field of catalysis, jewelry, absorbents, batteries, new forms of energy or electronics.

In the field of jewelry, it is thus possible to manufacture jewels made of metal foam (for example, gold jewels, in particular 24 carats) or to carry out a plating on the jewels to increase the wear resistance thereof.

The invention relates to, fourthly, a device comprising a metal foam of at least one metal M having a porous micrometric structure as defined above.

According to the invention, this device may in particular be a microelectrode, a micro-sensor, in particular a gas micro-sensor, a battery or instead a storage device, in particular a gas storage device.

Other characteristics and advantages of the invention will become clearer on reading the complement of the description that follows, which relates to the synthesis of different metal foams, in this particular case copper foams, and to the study of the influence of different parameters, and in particular the influence of gelatine, on the form, the volume and the structure of the metal foam, on the curve of the intensity as a function of the electric voltage I=f(U) and on the reduction of copper.

It is pointed out that this detailed description, which refers in particular to appended FIGS. 1 to 20, is only given by way of illustration of the subject-matter of the invention and does not constitute in any case a limitation of said subject-matter.

In particular, the method of synthesizing copper foam which is detailed hereafter is obviously transposable to the synthesis of a foam of one or more metals other than copper.

DETAILED DESCRIPTION OF PARTICULAR EMBODIMENTS

Experimental Device

Figure 1:
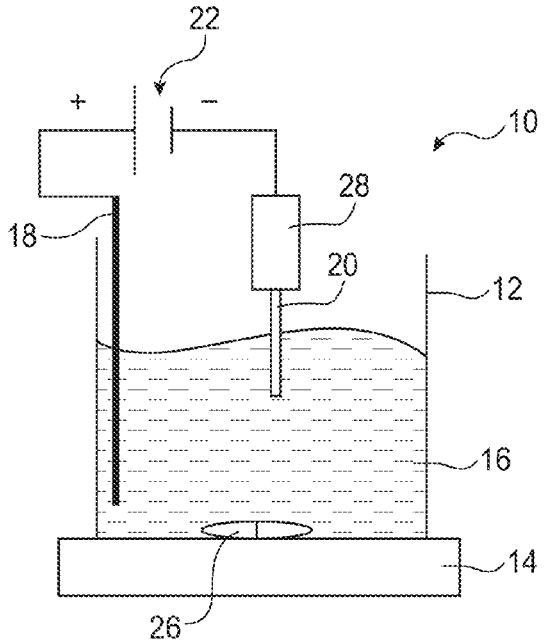
FIG. 1 is a schematic representation of the experimental device used during the tests.

In FIG. 1 is schematically represented the experimental device 10 used during the tests that have been conducted.

This experimental device 10 comprises a beaker 12 of a capacity of 500 ml placed on a magnetic stirrer 14. This beaker 12 comprises an electrolytic solution 16 in which are immersed two electrodes, namely an anode 18 and a cathode 20. The anode 18 and the cathode 20 are respectively connected to the positive and negative poles of a continuous electrical power supply 22, which makes it possible to apply an electric voltage going up to 35 volts. A coulometer (not represented) is also arranged in series between the anode 18 and the cathode 20. Said coulometer makes it possible to measure the amount of electrical charges brought into play during the contact glow discharge electrolysis. A charge-coupled device (CCD) camera (not represented), and which is equipped with an objective arranged inside the beaker 12, makes it possible to visualise in real time the formation of the metal foam on the cathode 20.

The anode 18 is formed of a copper strip of 10 cm length, 5 cm width and 0.2 mm thickness, whereas the cathode 20 is constituted of a tungsten wire, the diameter of which is comprised between 0.4 and 1 mm.

The electrolytic solution 16 comprises at least one first electrolyte in a solvent, the first electrolyte being the metal M in cationic form $M^{n+}$. The electrolytic solution 16 further comprises a second electrolyte, constituted of a strong electrolyte.

During the tests carried out, the electrolytic solution 16 is formed of an aqueous solution of copper sulphate at a temperature of 25° C. which comprises:

64 g/l of copper sulphate $CuSO_4$, $5H_2O$ as first electrolyte, 80 ml/l of 98% sulphuric acid $H_2SO_4$ as second electrolyte, and demineralised water as solvent.

The electrolytic solution 16 also comprises gelatine, in this particular case gelatine (CAS 9000708), the concentration of which varies between 0 g/l (this solution then corresponding to a reference electrolytic solution) and 25 g/l.

Copper sulphate is the salt that generates the copper cations $Cu^{2+}$ that will be reduced at the cathode 20, as will be seen hereafter. Said copper sulphate is totally ionised in the electrolytic solution 16, thanks in particular to the presence of the second strong electrolyte, in this particular case sulphuric acid. The presence of this sulphuric acid makes it possible to assure good electrical conductivity of the electrolytic solution 16 and moreover favours the corrosion of the copper anode 18.

The stirring of the electrolytic solution 16 may, if need be, be assured by a magnetic bar 26 arranged inside the beaker 12.

In the same way, rotating the cathode 20 may, if need be, be assured using a rotating motor 28 to which the cathode 20 is attached.

Demonstration of the Electrolytic Plasma Electrolysis Method

It will be recalled that the contact glow discharge electrolysis method, also designated "electrolytic plasma" electrolysis method, is a particular electrolytic method in which a plasma known as "electrolytic plasma" is localised between a polarised electrode and the electrolytic solution in which the electrodes are immersed.

This electrolytic plasma forms from an electric voltage known as "critical electric voltage" and noted $U_c$, following the ionisation of the gas that surrounds the polarised electrode and which is itself formed beforehand during the electrolytic reduction, or oxidation, of the solvent and of some of the compounds ionised in the electrolytic solution.

In this particular case and as will be seen hereafter, the electrolytic plasma, which is localised between the cathode 20 and the electrolytic solution 16, forms following the ionisation of the hydrogen $H_2$ which surrounds the cathode 20, said hydrogen being itself formed during the electrolytic reduction of the protons $H^+$ present in the electrolytic solution 16.

Such a contact glow discharge or electrolytic plasma electrolysis method may be demonstrated by establishing a measurement of the intensity I as a function of the applied electric voltage U, I=f(U).

Figure 2:
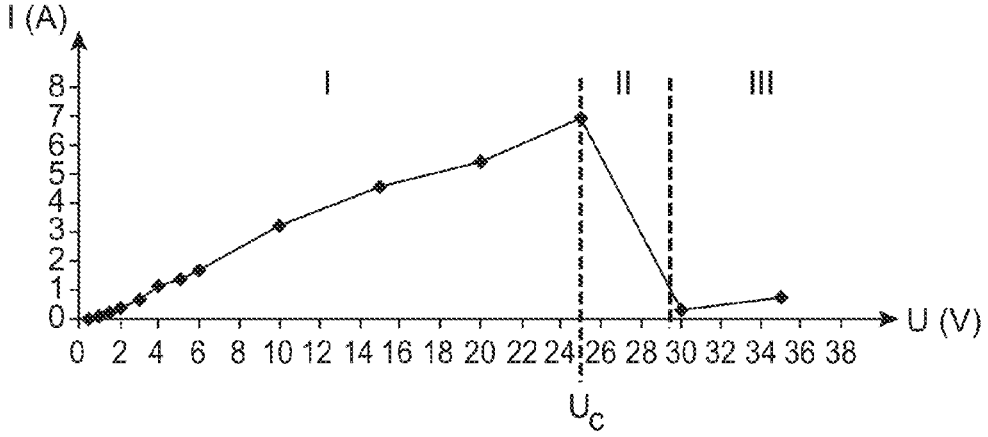
FIG. 2 represents the curve of the intensity, noted I (in A), measured as a function of the applied electric voltage, noted U (in V), as obtained experimentally.

Thus, FIG. 2 illustrates the curve of the intensity I in amperes (A) measured as a function of the electric voltage U in volts (V) applied at the cathode 20, as obtained experimentally with the device 10 described above with the electrolytic solution 16 formed by the aqueous solution of copper sulphate above, at a temperature of 25° C., and in the absence of gelatine, this solution corresponding to the electrolytic solution A, as will be seen later.

In this FIG. 2, it is observed that this curve may be broken down into three parts, respectively designated I, II and III, each of these parts corresponding to a separate process.

The first part of the curve, designated I, corresponds to a conventional electrolysis method (in this particular case, a cathodic reduction), in other words to a purely electrolytic method responding to Ohm's law, in which the intensity increases as a function of the applied electric voltage and does so up to an electric voltage value, known as "critical electric voltage" and noted $U_c$, of 25 V. In this range of electric voltages from 0 to 25 V, the surface of the immersed cathode 20 remains constantly wetted by the electrolytic solution 16 and is the seat of the reaction of reduction of copper (4). This reaction of reduction of copper (4) is accompanied, for the highest electric voltages, by the reaction of reduction of water (5) with release of hydrogen, in the form of bubbles that coalesce in the neighbourhood of the critical electric voltage $U_c$.

The corresponding electrolytic reduction reactions are the following:

$$Cu^{2+}+2e^{-}\rightarrow Cu \quad (4)$$

$$2H^{+}+2e^{-}\rightarrow H_2\nearrow \quad (5).$$

During this conventional electrolysis method, at the surface of the cathode 20, a deposition of copper is formed which has more and more nodules and an aspect more and more powdery as the applied electric voltage increases. An illustration of such a nodular and powdery deposition is given by FIG. 3, which corresponds to an image of the deposition of copper obtained at the surface of the cathode 20 during the application, to this cathode 20, of an electric voltage of 10 V.

From the critical electric voltage $U_c$, the intensity decreases sharply as a function of the applied electric voltage and does so up to an electric voltage value of 30 V, value from which the intensity stabilises.

This range of electric voltages, which extends from 25 V to 30 V, corresponds to the second part of the curve, designated II. This drop in the intensity as a function of the applied electric voltage is the consequence of the formation then of the growth, around the cathode 20, of the gaseous envelope, also designated "electrolytic plasma". In this part II, the contact glow discharge electrolysis method starts to be established. Since the electrical conductivity of this gaseous envelope is lower than that of the electrolytic solution 16, the intensity drops.

From an electric voltage value of 30 V, which corresponds to the third part designated III of the curve, the gaseous envelope is totally formed and isolates the cathode 20 from the electrolytic solution 16. In this part III, the intensity and the contact glow discharge electrolysis method are stabilised. The intensity, which is then measured, corresponds to the electrical discharges that are created, such electrical discharges being also known as "micro-arcs" or "micro-sparks".

Figure 4:
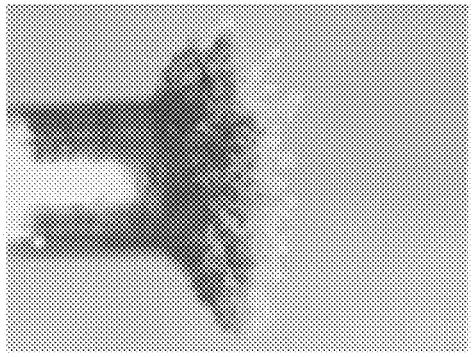
FIG. 4 corresponds to an image of a deposition of copper on a cathode as obtained by contact glow discharge electrolysis, during the application of an electric voltage of 25 V.

During this process of contact glow discharge electrolysis, at the surface of the cathode 20, a deposition of copper is formed which is in the form of an entanglement of multiple strands. Such an arrangement of metal strands is similar to a foam known as "metal foam". An illustration of such a metal foam formed by the deposition of multiple strands of copper is given in FIG. 4, which corresponds to an image of the deposition of copper obtained on the cathode 20 during the application, to this cathode 20, of an electric voltage of 25 V.

This demonstration of the contact glow discharge or electrolytic plasma electrolysis method that has been described may moreover be confirmed by the measurement of the temperature of the surface of the cathode 20 as a function of the electric voltage applied to this cathode 20.

To do so, the experimental device 10 described above has been modified. The cathode 20 has been replaced by a metal thermocouple at the tip of which the electrolytic plasma has been formed. The temperature measurements noted by the thermocouple, during the application of an electric voltage varying from 10 V to 35 V, are reported on the curve represented in FIG. 5. It is pointed out that the measurements are carried out with an uncertainty of +/−10° C.

Figure 5:
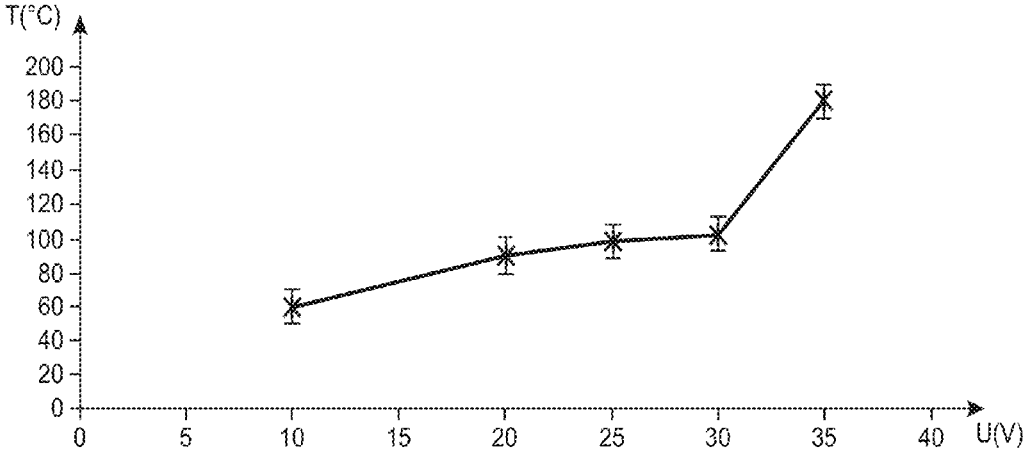
FIG. 5 represents the curve of temperatures noted T (in ° C.) as a function of the electric voltage noted U (in V) applied as obtained experimentally, these temperatures being measured at the surface of a thermocouple replacing the cathode of the experimental device represented in FIG. 1.

As this curve represented in FIG. 5 shows, the temperature measured by the thermocouple, which thus corresponds to the temperature of the surface of the cathode 20, sharply increases from an applied electric voltage of 30 V. This temperature corresponds to the temperature at which the gaseous envelope, or "electrolytic plasma", is totally formed. For an electric voltage of 35 V, the measured temperature reaches 180° C. In the literature, this temperature of 180° C. is designated "normal temperature" for this type of electrolytic plasma, furthermore also designated "cold plasma".

Synthesis of Different Copper Foams

Electrolytic Solutions

Different electrolytic solutions, referenced A to E, have been prepared. The composition of these electrolytic solutions is detailed in table 1 below.

These solutions A to E are aqueous solutions prepared with demineralised water as solvent. The gelatine used, which bears the registration number CAS 9000708, is introduced in the form of powder into the mixture. Said mixture is heated to a temperature of 60° C. so as to enable the complete dissolution of the gelatine in each of the electrolytic solutions B to E.

TABLE 1

| | Electrolytic solution | | | | |
|---|---|---|---|---|---|
| | A | B | C | D | E |
| Copper sulphate (g/l) | 64 | 64 | 64 | 64 | 64 |
| Sulphuric acid (ml/l) | 80 | 80 | 80 | 80 | 80 |
| Gelatine (g/l) | 0 | 1 | 5 | 10 | 25 |

These electrolytic solutions A to E are going to be successively introduced into the beaker 12 of the experimental device 10 described previously for the implementation of the contact glow discharge electrolysis method.

We will now describe the operating protocol followed for the implementation of said electrolytic plasma electrolysis method.

Operating Protocol

The operating protocol, which is going to be detailed below, is described in relation with the implementation of an electrolytic solution 16, the composition of which corresponds to the composition of the electrolytic solution A as detailed in table 1 above. This electrolytic solution A, which does not comprise gelatine, thus corresponds to a reference electrolytic solution as taught by the publication [1]. It is nevertheless pointed out that this operating protocol is entirely transposable for the implementation of the method of synthesizing metal foam according to the invention, with the electrolytic solutions B to E.

As has been seen previously, the formation and the growth of the gaseous envelope, or electrolytic plasma, occur around the cathode from the application of the critical electric voltage $U_c$, which is 25 V in the present case.

Reference may be made to FIGS. 6A to 6D, which schematically illustrate the successive steps of the operating protocol that has been followed to synthesize copper metal foams.

Figures 6A, 6B, 6C, 6D:
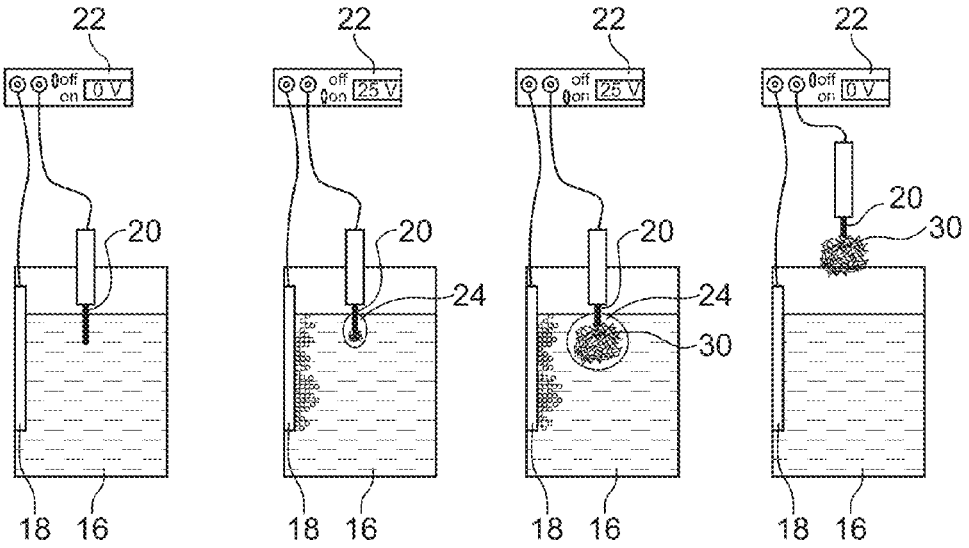
FIGS. 6A to 6D schematically represent the successive steps of the operating protocol followed to synthesize, by contact glow discharge electrolysis, a copper foam.

As represented in FIG. 6A, the anode 18 and cathode 20 of the experimental device 10 are immersed in the electrolytic solution 16. The anode 18 is connected to the positive pole of the electrical power supply 22 and the cathode 20 is, for its part, connected to the negative pole of this electrical power supply 22. As represented in FIG. 6A, the electrical power supply 22 does not deliver, at this precise moment, any electric voltage (U=0 V).

It is pointed out that, unless expressly indicated to the contrary, the following tests have been carried out in the absence of stirring of the electrolytic solution 16 and without rotating the cathode 20.

The electrical power supply 22 is then adjusted to an electric voltage comprised between 25 V and 35 V, then started to assure the formation and the growth of the electrolytic plasma 24 (FIG. 6B). In the case illustrated in FIGS. 6B and 6C, the electric voltage delivered by the electrical power supply 22 is set at U=25 V.

As soon as an electric voltage of 25 V is applied, the electrolytic plasma 24 forms then grows around the cathode 20. Electric micro-arcs form and evolve from the surface of the cathode 20 towards the interface situated between the electrolytic plasma 24 and the electrolytic solution 16. Since these electric micro-arcs are composed of negative charges, the copper cations $Cu^{2+}$ present in the electrolytic solution 16 are reduced at the end of each electric micro-arc, according to the aforementioned electrolytic reduction reaction (4). This reduction of the copper cations $Cu^{2+}$ creates, at the surface of the cathode 20, a copper foam 30 constituted of an entanglement of a multitude of copper strands, said strands representing the "negative" of the micro-arcs formed during the contact glow discharge electrolysis (CGDE) or electrolytic plasma electrolysis method. The formation and the growth of this metal foam 30 are illustrated in FIGS. 6B and 6C. The growth of this metal foam 30 continues as long as the electrolytic plasma 24 is maintained.

After ten or so seconds of functioning of the electrical power supply 22, the cathode 20 is withdrawn from the electrolytic solution 16 (in this particular case the electrolytic solution A), while remaining under the applied electric voltage of 25 V. In fact, to conserve the integrity of the copper metal foam 30 formed on the surface of the cathode 20, it is preferable to cut off the electric voltage delivered by the electrical power supply 22 after the cathode 20 is taken out of the electrolytic solution 16, as represented in FIG. 6D. In such conditions, the metal foam 30 formed at the surface of the cathode 20 is completely dry. Although it is relatively fragile, this copper foam 30 has nevertheless sufficient mechanical strength which makes it possible to detach it from the cathode 20, by pushing it using a small brush.

Figure 7:
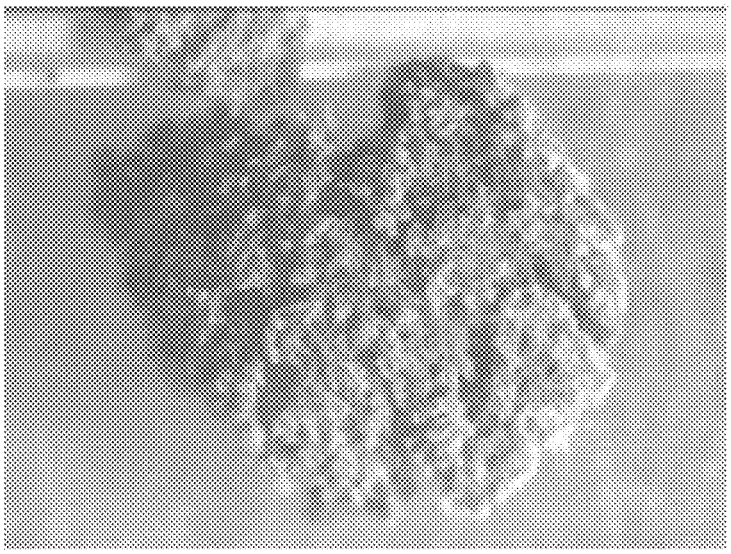
FIG. 7 corresponds to an image of the copper foam as obtained at the end of the operating protocol illustrated in FIGS. 6A to 6D.

The image of the copper metal foam 30 thereby obtained with the electrolytic solution A is reported in FIG. 7. In this FIG. 7, it may be observed that said copper foam 30 has an alveolar structure resulting from the entanglement of numerous strands of copper formed during the electrolytic plasma electrolysis method.

Figure 3:
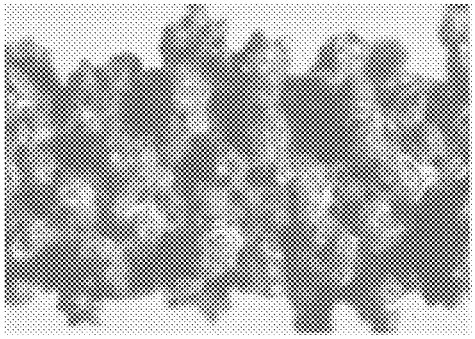
FIG. 3 corresponds to an image of a deposition of copper on a cathode as obtained by conventional electrolysis during the application of an electric voltage of 10 V.
Figure 8A:
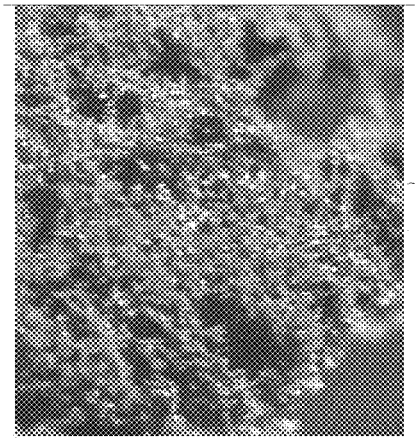
FIGS. 8A and 8B correspond to microscopic images of the copper foam of FIG. 7, FIG. 8A following observation using a binocular magnifier and FIG. 8B following observation using a scanning electron microscope (SEM).
Figure 8B:
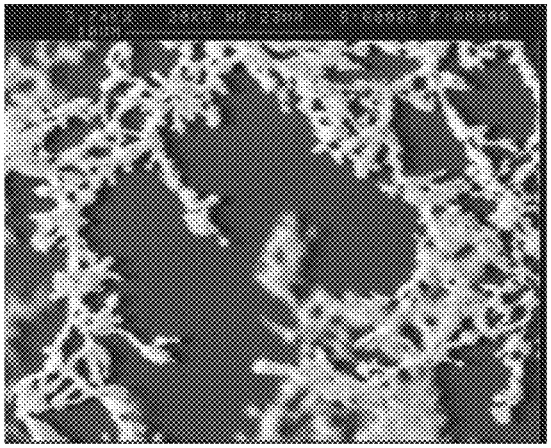

To confirm the spatial arrangement of the metal foam 30, microscopic images of said metal foam 30 have been taken. FIG. 8A is an image resulting from observation using a binocular magnifier whereas FIG. 8B is an image resulting from observation using a scanning electron microscope (SEM). It may be observed that the copper strands are very thin, with a dimension of the order of micrometer, and that they have a molten aspect that is unusual for structures that are obtained with the implementation of a conventional electrolysis method, as illustrated in FIG. 3.

Figure 9A:
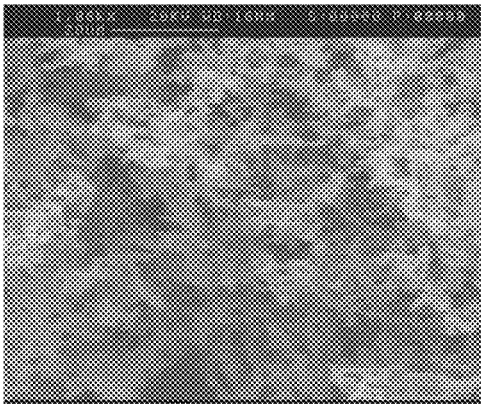
FIGS. 9A and 9B correspond to images taken using a scanning electron microscope (SEM) of this same copper foam of FIG. 7, FIG. 9A corresponding to the inside of the foam whereas FIG. 9B corresponds to the outside of the foam.
Figure 9B:
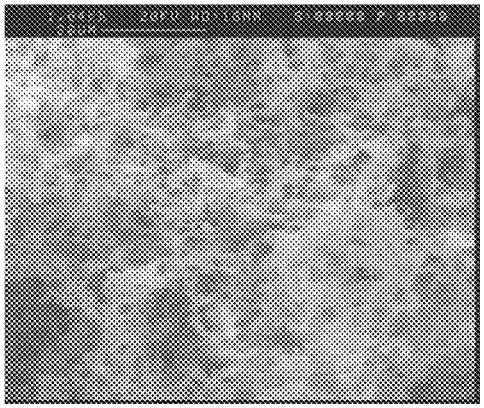

Referring to FIGS. 9A and 9B, which correspond to images taken using a scanning electron microscope (SEM), respectively of the inside and of the outside of the metal foam 30, it may be noted that this copper metal foam 30 has a nanometric structure in its core and at its edges, which is identical in terms of structure and density. The porosity is, consequently, constant throughout the thickness of the deposition of metal foam 30 obtained by the implementation of the electrolytic plasma electrolysis method.

Tests Carried Out and Results Obtained

The operating protocol described previously has been reproduced with the electrolytic solutions B to E of table 1 above.

Effects of Gelatine on the Form and the Volume of the Metal Foams

As has been seen, the metal foam obtained with the electrolytic solution A has a porous micrometric and homogenous structure throughout its thickness. However, as may be seen in the images of FIGS. 4 and 7, the fact remains that the metal foam synthesized with the electrolytic solution A has a general form which is systematically irregular.

On the contrary, the metal foams synthesized from electrolytic solutions B to E have, for their part, not only these same characteristics of porous micrometric and homogenous structure throughout their thickness, but also a particularly regular general form.

Figure 10A:
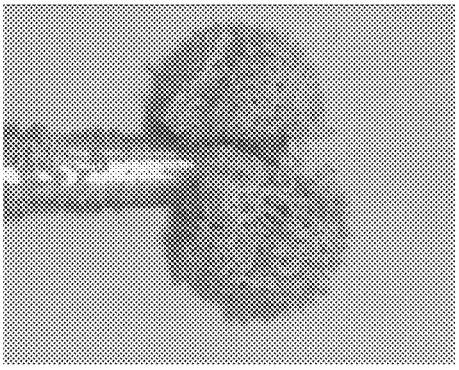
FIGS. 10A and 10B correspond to images of copper foams as synthesized at the surface of a cathode after the implementation of an electrolytic plasma electrolysis method.
Figure 10B:
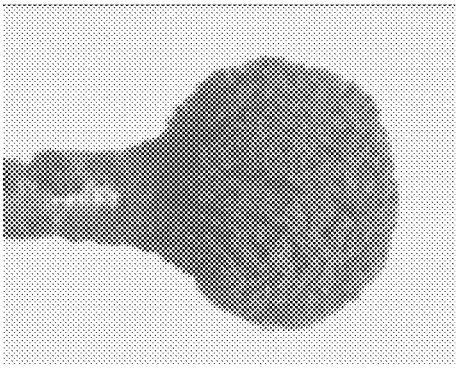

To visualise the important difference residing in the general forms of the synthesized metal foams, reference may be made to FIGS. 10A and 10B.

These FIGS. 10A and 10B correspond to images of copper foams as obtained at the surface of a cathode after the implementation of an electrolytic plasma electrolysis method in identical operating conditions, namely under an electric voltage of 25 V maintained for 5 seconds. More precisely, the image of FIG. 10A corresponds to the copper foam obtained with the implementation of the electrolytic solution A whereas the image of FIG. 10B corresponds to the copper foam obtained with the implementation of the electrolytic solution E.

It is clear from a comparison of these two images of FIGS. 10A and 10B that the general form of the metal foam synthesized according to the method of the invention is regular (FIG. 10B) and does not have zones of fragility or fracture, unlike the metal foam of the image of FIG. 10A.

Furthermore, as also indicated above, the metal foam synthesized from the electrolytic solution A is relatively fragile. Although it can be detached, by proceeding delicately using a small brush, from the cathode at the surface of which it has formed, it absolutely cannot be envisaged to subject said metal foam to a subsequent step of shaping, for example, by machining. This fragility is in particular linked to its general irregular form, as appears clearly in the image of FIG. 10A.

This irregularity of form, which characterises the metal foam obtained with the implementation of the electrolytic solution A, is brought about by the deformation of the gaseous envelope (or electrolytic plasma) during the contact glow discharge electrolysis method and, more particularly, during the growth of the metal foam. In fact, observation, using a CCD camera, of the phenomena occurring at the level of the cathode 20 during the contact glow discharge electrolysis shows that the formation of the metal foam occurs rapidly, in ten or so seconds, and in a quite violent manner: the gaseous envelope does not seem to have a sufficient robustness to withstand the forces created by the growth of this metal foam and is not able, consequently, to conserve a regular form around the cathode 20. It is even observed that after 15 seconds, this gaseous envelope breaks, thereby leading to the interruption of the electrolytic plasma as well as the total destruction of the metal foam formed.

It is thus noted that the synthesis of metal foam by contact glow discharge electrolysis as taught by the publication [1] does not make it possible to obtain a foam having a regular form but is also limited in terms of volume of metal foam obtained. In fact, in the absence of gelatine, the thickness of metal foam capable of being obtained is at the most of the order of 0.5 mm, on account of the destruction of this metal foam if the duration of the electrolytic plasma exceeds 15 seconds.

On the contrary, the implementation of an electrolytic solution comprising gelatine makes it possible to obtain a gaseous envelope which, as the CCD camera images show, remains uniform around the cathode during the growth of the metal foam and does so for a duration which is clearly longer than 15 seconds.

Figure 11:
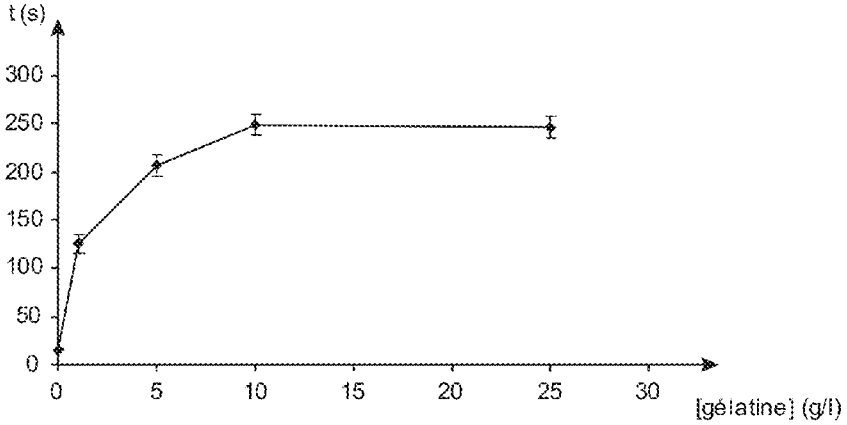
FIG. 11 represents the curve of the time of maintaining the gaseous envelope, noted t (in s), as a function of the gelatine concentration, noted [gelatine] (in g/l), of the electrolytic solution considered.

FIG. 11 clearly illustrates this phenomenon. In this FIG. 11 are reported the times at the end of which occurs the rupture of the gaseous envelope, which is formed during the electrolytic plasma electrolysis method generated under an electric voltage of 25 V, as a function of the gelatine concentration of the electrolytic solutions A to E implemented.

As FIG. 11 shows, the higher the gelatine concentration in the electrolytic solution, the greater the resistance of the gaseous envelope and, consequently, the greater the time of maintaining the electrolytic plasma.

As has been seen previously, if the electrolytic plasma breaks at the end of 15 seconds with the implementation of the electrolytic solution A, this electrolytic plasma may be maintained for a time of two minutes with a concentration of only 1 g/l of gelatine in the electrolytic solution B, or even attain 4 minutes with concentrations of 10 g/l and 25 g/l of gelatine (electrolytic solutions D and E).

It is not nevertheless imperative to maintain the electrolytic plasma over times longer than 1 minute to obtain a sufficient volume of metal foam. In fact, after only 45 seconds of electrolytic plasma implemented with the electrolytic solutions B to E, one obtains, at the surface of the cathode, depositions of metal foams which have a thickness of the order of 3 to 4 mm, thickness which is well above that of depositions of metal foam that it is possible to obtain with gelatine-free electrolytic solutions.

Figure 12A:
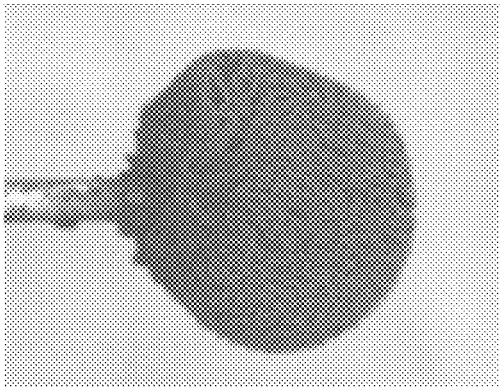
FIGS. 12A and 12B correspond to images of copper foams as synthesized at the surface of a cathode after the implementation of an electrolytic plasma electrolysis method of a duration of 45 and 60 seconds, respectively.
Figure 12B:
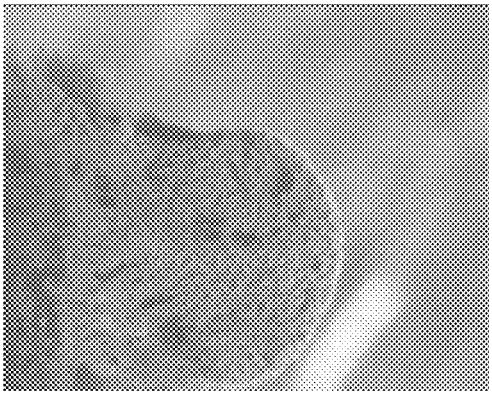

In fact, beyond one minute, the metal foams take a general form that is more irregular, as the image of FIG. 12B shows.

FIGS. 12A and 12B correspond to images of copper foams as obtained at the surface of the cathode after the implementation of the electrolytic solution E in the method according to the invention. The electrolytic plasma, generated under an electric voltage of 25 V, has been maintained for 45 seconds in the case of FIG. 12A, and for 60 seconds in the case of FIG. 12B.

Effects of Gelatine on the Curve of the Intensity as a Function of the Applied Electric Voltage To evaluate the effects of gelatine on the curve of the intensity as a function of the applied electric voltage, reference will be made to FIG. 13.

Figure 13:
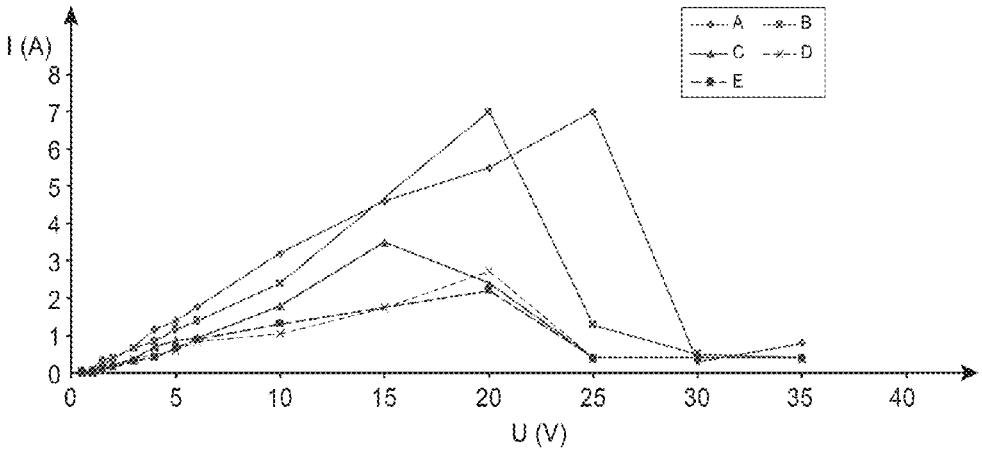
FIG. 13 represents the curve of the intensity, noted I (in A), measured as a function of the applied electric voltage, noted U (in V), as obtained with the implementation of the electrolytic solutions A to E in the electrolytic plasma electrolysis method.

This FIG. 13 represents the curve of the intensity, noted I (in A), measured as a function of the applied electric voltage, noted U (in V), as obtained with the implementation of the electrolytic solutions A to E, at a temperature of 25° C., in the electrolytic plasma electrolysis method.

It is observed that, the higher the gelatine concentration, the lower the intensity measured in the first part (Ohmic part) of the curve, which corresponds to electric voltages below the critical electric voltage $U_c$ and for which one is in the presence of a conventional electrolysis. In fact, the higher the gelatine concentration in the electrolytic solution, the greater the electrical resistance thereof. This increase in the electrical resistance limits electron transfer and, consequently, the amount of electrical charges exchanged during electrochemical reactions.

It may also be observed that the value of critical electric voltage $U_c$ from which the gaseous envelope begins to form around the cathode, which is 25 V with the implementation of the gelatine-free electrolytic solution A, attains a value of 20 V with the implementation of the electrolytic solutions B, D and E that comprise gelatine.

It will be recalled that the contact glow discharge electrolysis stabilises when the gaseous envelope is totally formed around the cathode, such a stabilisation occurring when the applied electric voltage value is situated in a range of electric voltages in which the intensity is substantially constant as a function of said electric voltage.

Yet, it is moreover observed that this contact glow discharge electrolysis stabilises at a lower electric voltage value when the electrolytic solution comprises gelatine and, in particular, from a value of 25 V with the implementation of the electrolytic solutions C, D and E.

Without the following tying down the inventor, the hypothesis retained to explain the aforementioned observations is that the gelatine could make it possible to better contain, at the surface of the cathode, the gaseous envelope formed by the release of hydrogen from the electrolytic reduction of the protons contained in the electrolytic solution, while reducing the solubility of said gaseous envelope in said electrolytic solution. Thus, when the electrolytic solution comprises gelatine, the gaseous envelope is entirely created at a lower electric voltage than when the electrolytic solution does not contain same and thus enables an ionisation of the gas and thus the complete formation of the electrolytic plasma at an electric voltage that is also lower.

It may finally be pointed out that FIG. 13 shows that, whatever the gelatine concentration in the electrolytic solution, the value of the intensity measured in the third part of the curve corresponding to the stabilisation of the contact glow discharge electrolysis method is constant and of the order of 0.5 A, as in the case of an electrolytic solution not comprising gelatine. This reflects the fact that the amount of electrical charges within the electrolytic plasma is constant.

Effects of Gelatine on the Reduction of Copper

To determine the effects of gelatine on the reduction of copper, the cathode efficiency R has been determined, defined as being the ratio between the mass of copper effectively deposited on the cathode (noted $m_{Cu\ deposited}$) and the theoretical mass of copper which should have been deposited on said cathode, if the totality of the electrical charges, brought into play during the electrolytic plasma electrolysis method, had been used for the electrolytic reduction of copper (noted $m_{Cu\ theoretical}$) according to the following formula (6):

$$R = \frac{m_{Cu\,deposited}}{m_{Cu\,theoretical}} \tag{6}$$

This cathode efficiency R has been calculated for each of the metal foams obtained at the end of the implementation of an electrolytic plasma electrolysis method carried out under an applied electric voltage of 30 V, for a time of 10 s, with each of the electrolytic solutions B to E.

To determine the theoretical mass of copper $m_{Cu\ theoretical}$, Faraday's first law is used, which postulates that 96 485 C are required to reduce 1 gram-equivalent of metal, gram-equivalent being the ratio between the mass number of said metal and the number of electrons exchanged to reduce one atom of said metal. The theoretical mass of copper $m_{Cu\ theoretical}$ as a function of the amount of electricity that has flowed through the circuit is given by the following formula (7):

$$m_{Cu\,theoretical} = \frac{Q \times M}{F \times n} \tag{7}$$

with:

Q=amount of electricity (in C) as measured

F=Faraday constant, i.e. 96 485 C/mol

M=mass number of copper (in g/mol), i.e. 63.546 g/mol n=the number of electrons brought into play during the electrolytic reduction reaction (4) of copper as described above, i.e. n=2.

The determination of the total amount of electrical charges brought into play during the electrolytic plasma electrolysis method, which corresponds to the amount of electricity noted Q, has been made by a coulometric measurement carried out using an EGG PARC type coulometer.

In table 3 below, are reported the values:

- of the deposited mass of copper $m_{Cu\ deposited}$ (in g) measured at the end of the tests,
- of the amount of electricity Q (in C) measured throughout the duration of the electrolytic plasma generated during the tests,
- of the theoretical mass of copper $m_{Cu\ theoretical}$ (in g) calculated by the application of the aforementioned formula (7), and
- of the cathode efficiency R (in %) calculated by the application of the aforementioned formula (6).

TABLE 3

| Electrolytic solution | $m_{Cu\ deposited}$ (in g) | Q (in C) | $m_{Cu\ theoretical}$ (in g) | R (in %) |
|---|---|---|---|---|
| B | 0.00034 | 7.386 | 0.00243 | 13.98 |
| C | 0.00048 | 7.272 | 0.00239 | 20.04 |
| D | 0.00060 | 7.590 | 0.00250 | 24.01 |
| E | 0.00062 | 7.166 | 0.00240 | 26.27 |

Figure 14:
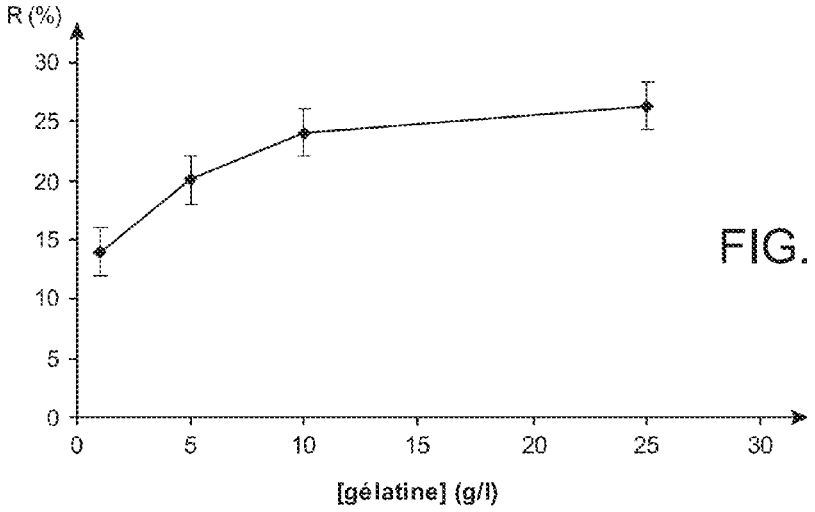
FIG. 14 represents the curve of cathode efficiency, noted R (in %), measured as a function of the gelatine concentration, noted [gelatine] (in g/l), of the electrolytic solution considered, during the implementation of an electrolytic plasma carried out under an applied electric voltage of 30 V, for a time of 10 s.

Appended FIG. 14 represents the curve corresponding to the cathode efficiency R thereby calculated as a function of the gelatine concentration, noted [gelatine], of these electrolytic solutions B to E.

It may be noted that this cathode efficiency R increases with the gelatine concentration in the electrolytic solution. Thus, for comparable amounts of electricity Q, the proportion of electrical charges dedicated to the electrolytic reduction of the copper cations $Cu^{2+}$ increases with the gelatine concentration of the electrolytic solution until tending towards a levelling off for a gelatine concentration of the order of 10 g/l.

Although it has previously been shown than the increase of the gelatine concentration causes the increase of the electrical resistance of the electrolytic solution, the electrical resistance thus becoming theoretically less favourable to the electrolytic reduction of the cations $Cu^{2+}$, the appearance of the curve of FIG. 14 tends to prove that the increase in the cathode efficiency R as a function of said gelatine concentration is directly linked to an increase in the electrical density in the gaseous envelope or electrolytic plasma. Thus, the more the gelatine concentration increases, the less the gaseous envelope generated at the cathode dissolves in the electrolytic solution. In these conditions, the gas pressure inside the gaseous envelope increases, leading to a more energetic electrolytic plasma, which thus has a higher electrical density.

Effects of Gelatine on the Structure of the Metal Foams

Different metal foams have been obtained from the implementation of the electrolytic solutions B to E in the electrolytic plasma electrolysis method under an applied electric voltage of 25 V, for a time of 10 s.

To characterise each of these metal foams, images thereof have been taken at different magnifications (×2 000, ×10 000 and ×70 000) using a scanning electron microscope (SEM), referenced ESM LMTDIMEB002.

Figure 15:
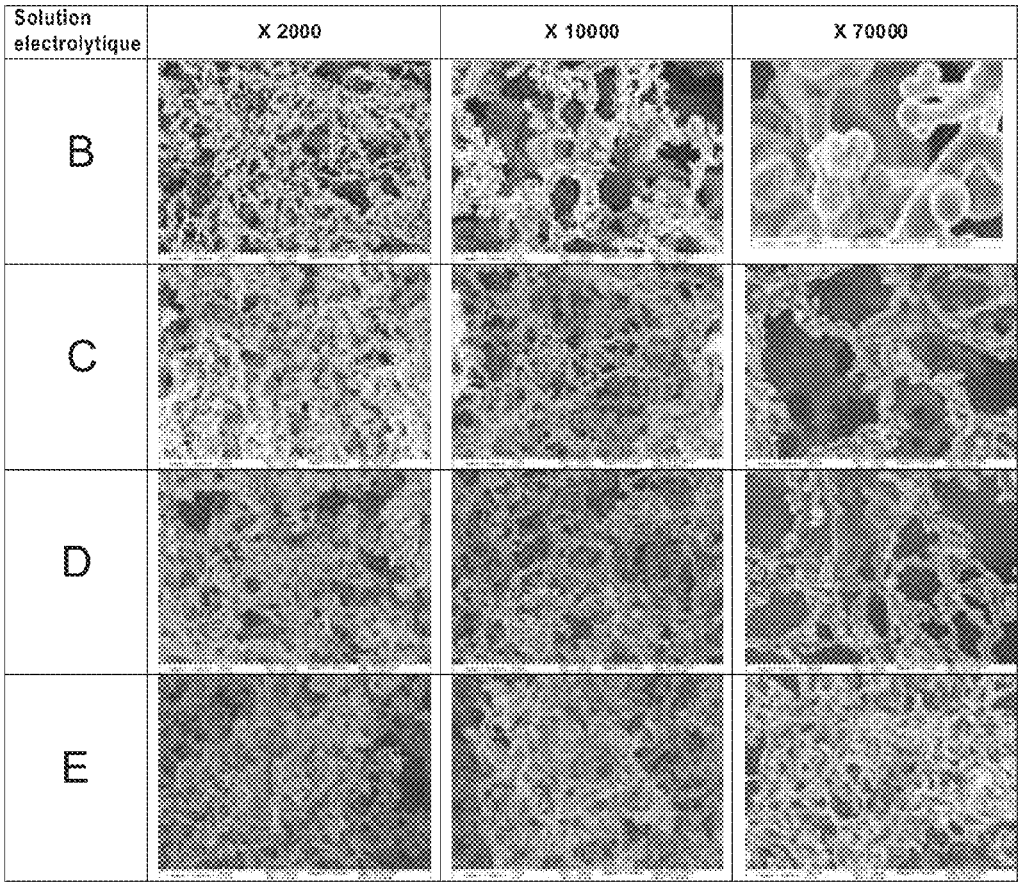
FIG. 15 groups together images taken at different magnifications using a scanning electron microscope (SEM) of copper foams synthesized with the implementation of the electrolytic solutions A to E in the electrolytic plasma electrolysis method under an applied electric voltage of 25 V, for a time of 10 s.

As the images of FIG. 15 show, the increase of the gelatine concentration in the electrolytic solution makes it possible to refine the structure of the metal foam.

As an illustration, it is observed that the metal foam obtained with the electrolytic solution B comprising 1 g/l of gelatine is formed of copper strands having a dimension comprised between 500 nm and 1 000 nm whereas the metal foam obtained with the electrolytic solution E comprising 25 g/l of gelatine is formed of copper strands, the dimension of which is only of the order of 100 nm.

Furthermore, the increase of the gelatine concentration in the electrolytic solution brings about the increase of the number of metal strands as well as the reduction in the size of the interstices between the metal strands.

Finally, the images obtained at high magnification of ×70 000 show that the metal strands of the foams obtained with the electrolytic solutions B to D comprise small nodules that have a structure similar to that of depositions of copper obtained with the conventional electrolysis method. It is nevertheless important to note that the presence of such nodules decreases as the gelatine concentration in the electrolytic solution increases to totally disappear at a concentration of 25 g/l (electrolytic solution E). This finding also seems to confirm that the higher the gelatine concentration in the electrolytic solution, the more rapid and intense the reaction of electrolytic reduction of the cations $Cu^{2+}$, which takes place at the interface situated between the gaseous envelope and the electrolytic solution, in all likelihood due to a more and more energetic electrolytic plasma.

In addition to characterisation using the scanning electron microscope, the metal foam obtained with the implementation of the electrolytic solution E in the electrolytic plasma electrolysis method under an applied electric voltage of 25 V, for a time of 10 s, has been analysed using an energy dispersive X-ray spectrometry (EDX), referenced ESM LMTPCMEB001 in order to determine the chemical composition of said metal foam.

Figure 16:
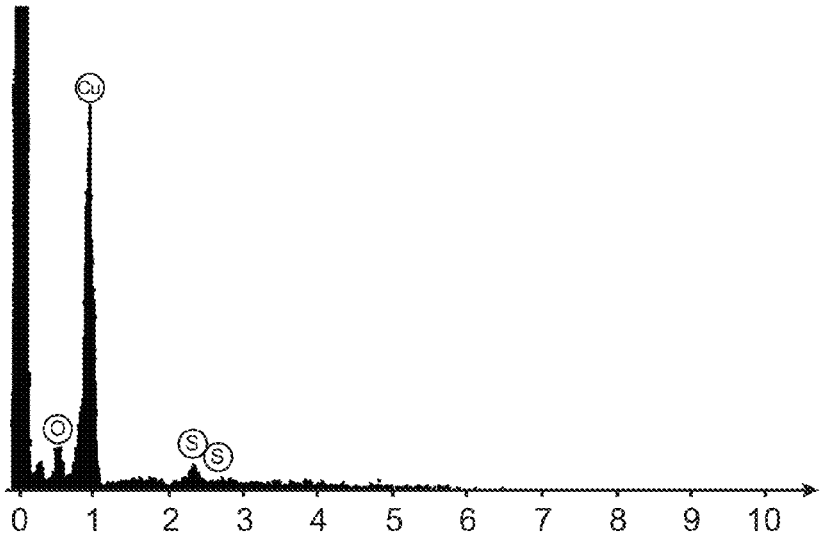
FIG. 16 corresponds to an energy dispersive analysis spectrum of a metal foam synthesized with the implementation of the electrolytic solution E in the electrolytic plasma electrolysis method under an applied electric voltage of 25 V, for a time of 10 s.

The spectrum obtained, reported in FIG. 16, show that the majority element of the metal foam remains copper, with a concentration of the order of 80% atomic. The only other two elements also present are oxygen and sulphur, which come from the other compounds present in the electrolytic solution ($CuSO_4$, $H_2SO_4$ and $H_2O$), with concentrations of the order of 15% atomic and 5% atomic, respectively.

This finding is the same, whatever the gelatine concentration present in the electrolytic solution B to E considered.

Effects of the Applied Electric Voltage on the Structure of the Metal Foams

If reference is made to FIG. 13, it may be observed that, for a gelatine concentration of 25 g/l in the electrolytic solution E, the curve of the intensity I as a function of the electric voltage U applied shows that it is possible to stabilise an electrolytic plasma from an applied electric voltage of 25 V (see FIG. 13).

To determine the effect that the applied electric voltage may have on the structure of the metal foams, two metal foams have been synthesized from the implementation of this electrolytic solution E in the electrolytic plasma electrolysis method, for a time of 10 s, under two separate electric voltages applied, one of 25 V and the other of 30 V.

Figure 17A:
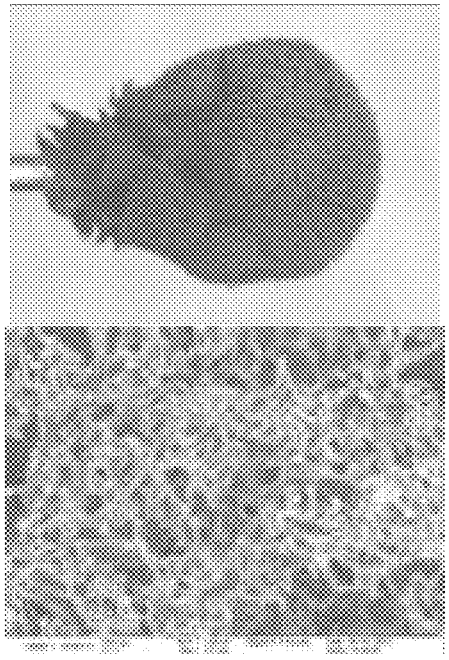
FIGS. 17A and 17B group together images taken by microscope and by scanning electron microscope (SEM) of metal foams synthesized with the implementation of the electrolytic solution E in the electrolytic plasma electrolysis method under two applied electric voltages of 25 V (FIG. 17A) and 35 V (FIG. 17B), for a time of 10 s.
Figure 17B:
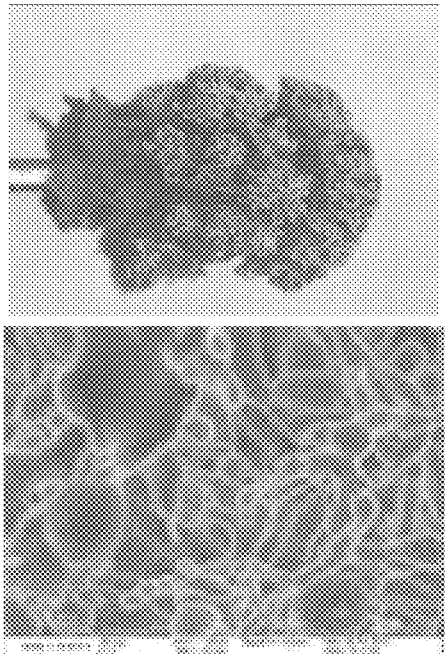

The images of the metal foams obtained by microscope and by scanning electron microscope (SEM) show that the variation of the applied electric voltage has an incidence on the structure of the metal foam. The copper foam obtained with an applied electric voltage of 35 V (FIG. 17B) has a less regular structure, characterised by the presence of cracks, than the copper foam obtained with an applied electric voltage of 25 V (FIG. 17A). In addition, the metal strands of this copper foam obtained with an applied electric voltage of 35 V are thicker than those of the copper foam obtained with an applied electric voltage of 25 V. It thus appears that the higher the applied electric voltage, the more micro-arcs are generated in the electrolytic plasma.

Evaluation of the Apparent Density of Metal Foams

First Series of Metal Foams MM1 to MM3

Measurements aiming to determine the mass (noted m and expressed in μg) and the apparent volume (noted V and expressed in $cm^3$) have been carried out to make it possible to calculate the apparent density (noted ρ and expressed in $g/cm^3$) of three copper foams MM1, MM2 and MM3 synthesized successively from the electrolytic solution E, according to the synthesis method according to the invention conducted under an applied electric voltage of 25 V and for a time of 15 s, in the absence of stirring of the electrolytic solution E and in the absence of rotation of the cathode.

The apparent density ρ is calculated from the following formula (8):

$$\rho = \frac{m}{V} \quad (8)$$

Figure 18A:
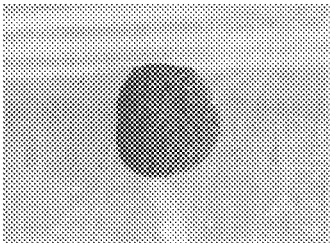
FIGS. 18A, 18B and 18C correspond to images taken using a microscope of three metal foams noted MM1, MM2 and MM3 synthesized with the implementation of the electrolytic solution E in the electrolytic plasma electrolysis method according to the invention, under an applied electric voltage of 25 V, for a time of 15 s.
Figure 18B:
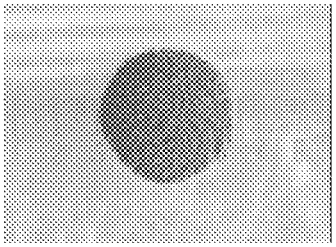
Figure 18C:
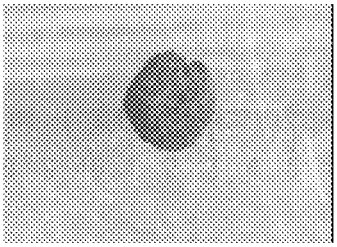

The microscopic images of these three metal foams MM1, MM2 and MM3 are reported in appended FIGS. 18A to 18C.

It is observed that these three metal foams MM1, MM2 and MM3 indeed have a same porous micrometric structure.

The noted values of mass m, apparent volume V and apparent density ρ calculated for the three metal foams evaluated are reported in table 4 below.

In table 4 are also shown the values of apparent density ρ calculated in percentage, relating to the theoretical density of copper, which is 8.92 g/cm$^3$ at 20° C.

It should however be pointed out that if the metal foams obtained by the implementation of the method according to the invention have a homogenous and regular structure, they are not nevertheless perfectly spherical, as may be observed in the images of these FIGS. 18A à 18C. Thus, the determination of the apparent volume V and, consequently, the apparent density ρ is tainted by an uncertainty that is mentioned in table 4 below.

TABLE 4

| | Metal foam | | |
|---|---|---|---|
| | MM1 | MM2 | MM3 |
| | Electrolytic solution | | |
| | E | E | E |
| Figure | 18A | 18B | 18C |
| m (in μg) | 862 | 1240 | 204 |
| V (in Cm$^3$) | 0.00362 | 0.00413 | 0.00045 |
| ρ (in g/cm$^3$) | 0.238 +/− 0.026 | 0.3 +/− 0.073 | 0.451 +/− 0.097 |
| ρ (in %) | 2.66 | 3.35 | 5.06 |

Whatever the case, the apparent density percentage values as calculated and reported in table 4 give an order of magnitude of the apparent densities of the metal foams that it is possible to obtain with the method according to the invention.

Such apparent density percentage values of the metal foams capable of being obtained and obtained by the method of the invention are at the most of the order of 10%.

Second Series of Metal Foams MM4 to MM7

Similar measurements aiming to determine the mass (noted m and expressed in μg) and the apparent volume (noted V and expressed in cm$^3$) have been carried out to make it possible to calculate the apparent density (noted ρ and expressed in g/cm$^3$) of four copper foams MM4, MM5, MM6 and MM7 synthesized successively from the electrolytic solution E, according to the synthesis method according to the invention conducted under an applied electric voltage of 25 V and for a time of 15 s.

In this second series of tests, and unlike the preceding, the electrolytic solution E is maintained under stirring at an angular velocity of 220 rpm, whereas the cathode is maintained in rotation at an angular velocity of 300 rpm, throughout the synthesis.

Figure 19:
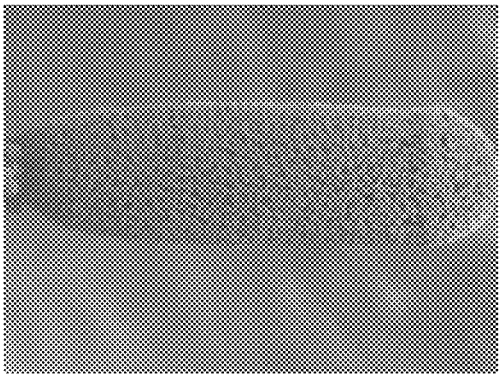
FIG. 19 corresponds to an image taken by microscope of the metal foam noted MM5 synthesized with the implementation of the electrolytic solution E maintained under stirring in the electrolytic plasma electrolysis method according to the invention, under an applied electric voltage of 25 V, for a time of 15 s, the cathode being moreover rotated.

The image of FIG. 19 corresponds to the metal foam MM5.

The values of mass m noted as well as the values of apparent volume V, apparent density ρ in g/cm$^3$ and in % calculated as above for the four metal foams are reported in table 5 below.

TABLE 5

| | Metal foam | | | |
|---|---|---|---|---|
| | MM4 | MM5 | MM6 | MM7 |
| | Electrolytic solution | | | |
| | E | E | E | E |
| Figure | | 19 | | |
| m (in μg) | 870 | 560 | 890 | 760 |
| V (in Cm$^3$) | 0.0245 | 0.0253 | 0.0237 | 0.0189 |
| ρ (in g/cm$^3$) | 0.035 | 0.022 | 0.038 | 0.040 |
| ρ (in %) | 0.39 | 0.25 | 0.43 | 0.45 |

The observation of the image of FIG. 19, which corresponds to the foam MM5, shows that, when the synthesis method according to the invention is implemented with a rotating cathode, the metal foam obtained, in addition to having a homogenous and regular structure, is also of regular shape.

Moreover, and in a completely surprising manner, the rotation of the cathode makes it possible to attain apparent density values practically ten times lower than those obtained and reported in table 4.

Figure 20:
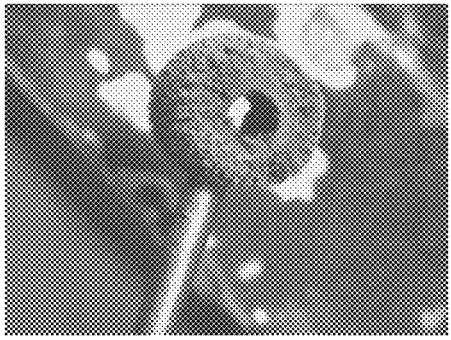
FIG. 20 corresponds to an image taken by microscope of the metal foam MM5 of FIG. 19, after machining in the form of a cylinder.

Despite this particularly low apparent density value, the metal foam MM5 has been able to be detached easily from the cathode, machined in the form of a cylinder and handled using a micro-sucker in the absence of any degradation thereof, as illustrated in the image of FIG. 20.

BIBLIOGRAPHY

[1] C. Zhou et al., *Electrochemistry Communications,* 2012, 18, pages 33-36

[2] K. Azumi et al., *Electrochimica Acta,* 2007, 52, pages 4463-4470

[3] R. Wüthrich et al., *Electrochimica Acta,* 2010, 55, pages 8189-8196

[4] T. A. Kareem et al., *Ionics,* 2012, 18, pages 315-327

[5] O. Takai, *Pure Appl. Chem.,* 2008, 80(9), pages 2003-2011

The invention claimed is:

1. A method of synthesizing a metal foam, said method comprising:

performing contact glow discharge electrolysis (CGDE) in an electrolytic plasma reduction conducted in an electrolytic solution in which are immersed an anode and a cathode connected to a continuous electrical power supply, wherein said performing CGDE in an electrolytic plasma reduction includes introducing the anode and the cathode into the electrolytic solution, applying an electric voltage, delivered by the continuous electrical power supply, greater than or equal to a critical electric voltage, so as to form at least partially the electrolytic plasma around the cathode, maintaining said electric voltage so as to form electric micro-arcs that reduce the metal M in cationic form so as to form the metal foam of the metal M on a surface of the cathode, and withdrawing the cathode from the electrolytic solution during said maintaining of the electric voltage, wherein said metal foam comprises at least one metal M having a porous structure and having strands with a dimension of between 0.01 μm and 100 μm, wherein the electrolytic solution comprises at least one first electrolyte in a solvent, wherein the first electrolyte is said at least one metal M in cationic form, and wherein the electrolytic solution further comprises gelatine.

2. The method according to claim 1, wherein said applying an electric voltage includes maintaining the electrolytic plasma in the form of a gaseous envelope around the cathode using the gelatine, and the method further comprises:

removing said metal foam from said surface of the cathode.

3. The method according to claim 1, wherein the applied electric voltage is situated in a range of electric voltages having an intensity substantially constant as a function of said electric voltage.

4. The method according to claim 1, wherein the electric voltage applied to the cathode is turned off after said withdrawing the cathode from the electrolytic solution.

5. The method according to claim 1, further comprising: stirring the electrolytic solution.

6. The method according to claim 1, wherein the applied electric voltage is between 10 V and 100 V.

7. The method according to claim 6, wherein the applied electric voltage is between 15 V and 50 V.

8. The method according to claim 7, wherein the applied electric voltage is between 20 V and 30 V.

9. The method according to claim 1, wherein the applied electric voltage is maintained for a duration of between 5 s and 5 min.

10. The method according to claim 9, wherein the applied electric voltage is maintained for a duration of between 10 s and 2 min.

11. The method according to claim 10, wherein the applied electric voltage is maintained for a duration of between 20 s and 60 s.

12. The method according to claim 1, further comprising: shaping the metal foam.

13. The method according to claim 12, wherein the shaping comprises performing at least one selected from electroforming and machining.

14. The method according to claim 1, wherein a concentration of said gelatine in the electrolytic solution is less than or equal to 200 g/l.

15. The method according to claim 14, wherein the concentration of said gelatine in the electrolytic solution is between 1 g/l and 100 g/l.

16. The method according to claim 15, wherein the concentration of said gelatine in the electrolytic solution is between 5 g/l and 50 g/l.

17. The method according to claim 16, wherein the concentration of said gelatine in the electrolytic solution is between 10 g/l and 25 g/l.

18. The method according to claim 1, in which the first electrolyte is a metal salt.

19. The method according to claim 18, in which the metal salt comprises at least one element selected from a sulphate, a nitrate, a halide, a cyanide $CN^-$, and a hydroxide of the metal M.

20. The method according to claim 1, in which a concentration of the first electrolyte in the electrolytic solution is less than or equal to a solubility of said first electrolyte in the solvent.

21. The method according to claim 20, wherein the concentration of said first electrolyte in the electrolyte solution is between 0.1 mol/l and 2 mol/l.

22. The method according to claim 21, wherein the concentration of said first electrolyte in the electrolyte solution is between 0.2 mol/l and 1 mol/l.

23. The method according to claim 1, in which the solvent is water.

24. The method according to claim 23, wherein the solvent is demineralised water.

25. The method according to claim 1, wherein the electrolytic solution further comprises at least one second electrolyte which increases electrical conductivity of the electrolytic solution.

26. The method according to claim 25, in which the second electrolyte is a salt, an acid, or a base.

27. The method according to claim 25, in which a concentration of the second electrolyte in the electrolytic solution is less than or equal to a solubility of said second electrolyte in the solvent.

28. The method according to claim 27, wherein the concentration of said second electrolyte in the electrolytic solution is between 0.1 mol/l and 18 mol/l.

29. The method according to claim 28, wherein the concentration of said second electrolyte in the electrolytic solution is between 0.5 mol/l and 10 mol/l.

30. The method according to claim 1, in which the cathode is made of stainless steel, tantalum, or tungsten.

31. The method according to claim 1, in which the anode is made of the metal M.

32. The method according to claim 1, in which the metal M comprises at least one element selected from transition metals and tin.

33. The method according to claim 1, in which the metal foam of metal M formed at the surface of the cathode has a thickness of between 0.1 mm and 10 mm.

34. The method according to claim 33, wherein the metal foam of metal M formed at the surface of the cathode has a thickness of between 0.3 mm and 5 mm.

35. The method according to claim 34, wherein the metal foam of metal M formed at the surface of the cathode has a thickness of between 0.5 mm and 2 mm.

36. The method according to claim 1, in which the metal foam of metal M has an apparent density less than or equal to 10% of the theoretical density of the corresponding metal M.

37. The method according to claim 36, wherein the metal foam of metal M has an apparent density of between 1% and 8% of the theoretical density of the corresponding metal M.

38. The method according to claim 37, wherein the metal foam of metal M has an apparent density of between 1.5% and 5% of the theoretical density of the corresponding metal M.

39. The method according to claim 1, further comprising: collecting the metal foam of the metal M formed on the surface of the cathode.

40. The method according to claim 1, further comprising: rotating the cathode when the cathode is arranged in the electrolytic solution.

* * * * *